United States Patent [19]

Johansson

[11] Patent Number: 4,512,676

[45] Date of Patent: Apr. 23, 1985

[54] LOCKING ASSEMBLY FOR RESTRICTING PIVOTAL MOVEMENT OF A PRINT UNIT TO A POSITION IN WHICH A PRINT ELEMENT CAN BE REPLACED

[75] Inventor: Hans L. Johansson, Karlshamn, Sweden

[73] Assignee: Facit Aktiebolag, Atvidaberg, Sweden

[21] Appl. No.: 489,310

[22] Filed: Apr. 28, 1983

[30] Foreign Application Priority Data

May 5, 1982 [SE] Sweden ..... 8202814

[51] Int. Cl.[3] ..... B41J 1/30

[52] U.S. Cl. ..... 400/144.2; 400/175

[58] Field of Search ..... 400/144.2, 144.3, 174, 400/175

[56] References Cited

U.S. PATENT DOCUMENTS 4,299,502 11/1981 Harre ..... 400/175 X 4,347,005 8/1982 Lendl ..... 400/175 X

*Primary Examiner*—Paul T. Sewell

*Attorney, Agent, or Firm*—Roberts, Spiecens and Cohen

[57] ABSTRACT

Printing apparatus for electric office machines a print unit having a motor (14) and a disk-shaped type element (17) connectable with the motor shaft (16). The print unit is pivotably mounted for movement between a printing position, in which the type element is fixed for movement with the motor shaft, and an upwardly pivoted position in which the type element is disengaged from the motor shaft to allow replacement. A locking system permits upward pivoting of the print unit only when the type element has assumed a predetermined angle. The locking system comprises a lock collar (23) rigidly connected to the motor shaft (16) and having an end wall in which there are at least two axially directed recesses (24), or alternatively having at least two axially directed pins, the recesses or pins coacting with complementary parts (39) arranged on a disengagement systems (33, 34, 36, 37), axially displaceable during the pivoting movement.

8 Claims, 4 Drawing Figures

LOCKING ASSEMBLY FOR RESTRICTING PIVOTAL MOVEMENT OF A PRINT UNIT TO A POSITION IN WHICH A PRINT ELEMENT CAN BE REPLACED

FIELD OF THE INVENTION

The present invention relates to an assembly for printing apparatus for electric office machines.

More particularly, the invention relates to an apparatus in which a print unit is pivotably moved from a print position to a pivoted position in which a print element on a drive shaft of a motor can be replaced. The apparatus includes a locking assembly which prevents the print unit from reaching the print position unless the print element is in a particular angular position on the drive shaft.

BACKGROUND

An assembly is disclosed in U.S. Pat. No. 4,299,502 in which the locking assembly includes a lock washer rotatable with the motor shaft, said washer being provided, at its periphery, with a radial recess. A detent means pivotably mounted on the print unit coacts with said recess. The detent member is spring biased towards the periphery of the lock washer and coacts with a stopping edge situated in the machine for preventing the print unit from tipping except when in the angular position determined by the recess in the washer, said position corresponding to the nesting position of the type element.

SUMMARY OF THE INVENTION

In the known assembly, the detent member, the spring members required for its biasing towards the lock washer as well as the stop edge situated in the machine are only arranged for the purpose of the locking assembly. An object of the invention is to provide a locking assembly in which the locking function is achieved without coaction with said parts.

This object is achieved in an assembly comprising a lock collar member rigidly attached to the motor shaft of the drive motor and having an end face in facing relation with a disengagement member which is axially displaceable of the motor shaft towards the collar member during pivotal movement of the print unit from its print position to its pivoted position. One of the members includes a plurality of axially extending pins and the other member is provided with a plurality of complementary recesses which are in engagement with the pins only when the type element of the print unit is in a predetermined angular position. The pivotal movement of the print unit to the pivoted position is permitted only when the pins are engaged in the recesses.

BRIEF DESCRIPTION OF DRAWINGS

An embodiment of the invention will now be described in conjunction with the accompanying drawings, in which.

BEST MODE FOR CARRYING OUT THE INVENTION

Figure 1:
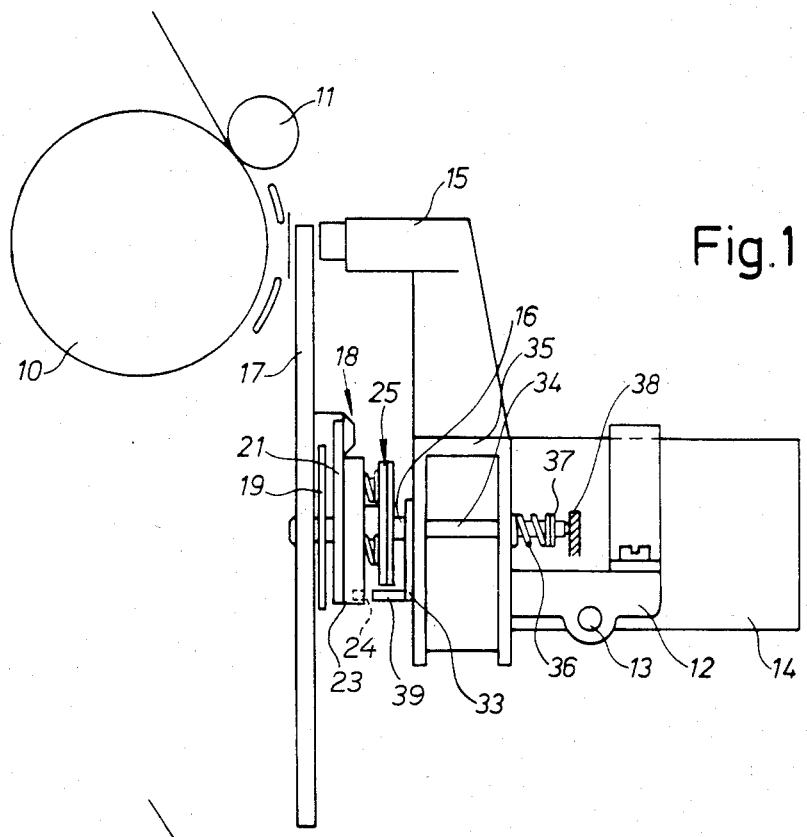
FIG. 1 is a side view diagrammatically illustrating a printing apparatus in the printing position.
Figure 4:
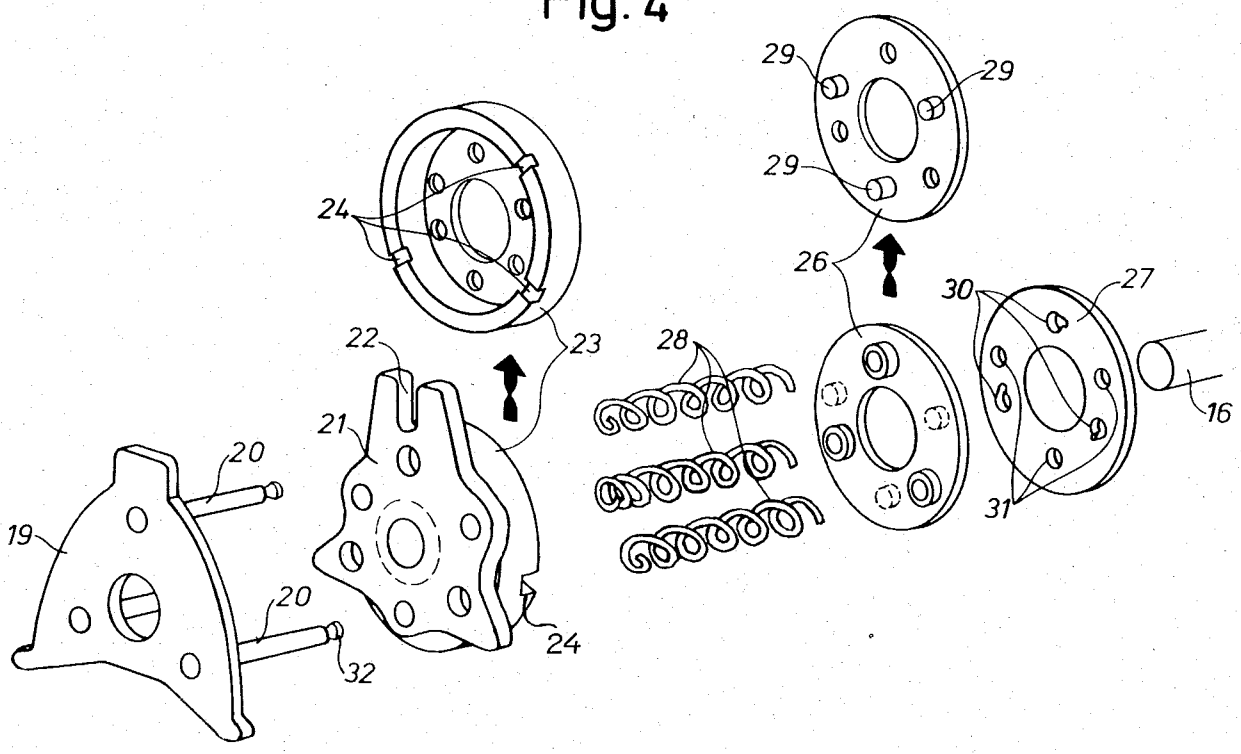
FIG. 4 is a perspective exploded view showing a disengagement means for the type element.

As seen from FIG. 1, the machine has a paper platen 10 with the aid of which paper is advanced. The paper is pressed against the platen by means of a press roll 11. Printing apparatus is carried by a support structure 12 for pivotable movement about a shaft 13, which is mounted on a carriage unit (not shown). The carriage unit can move parallel to the platen. The support structure 12 is pivotable about the shaft 13 a type element motor 14 and a print hammer 15. The motor 14 has a shaft 16, at the end of which a type element 17 is detachably mounted by a connection generally denoted by numeral 18. The general function and construction of the coupling and type element are described in detail in Swedish Pat. No. 7900299-4, although the coupling illustrated in the embodiment herein will be summarily described in conjunction with FIG. 4. The coupling includes a substantially triangular fixing plate 19 on which the type element can be attached by the engagement of hooks (not shown) with stops on the plate. The plate is provided with rods 20 extending through a dog member 21. The dog member is attached to the motor shaft 16 and has a guide recess 22 in which a guide on the type element can engage. The dog member is further provided with a lock collar 23 comprising a cylindrical portion with end walls and three axial recesses 24 in one end wall. The function of these recesses will be described in detail in the following. The rods 20 are further connected to a pressure plate 25, comprising a guide washer 26 and a lock washer 27, each rod being surrounded by compression springs 28. The guide washer 26 has a through hole for each rod and is further provided with a plurality of locking pins 29. The lock washer 27 has a plurality of keyhole-shaped openings 30 and additional openings 31 for receiving the locking pins on the guide washer. In assembling the parts the rods 20 are taken through corresponding holes in the dog member 21 and lock collar 23 after which both compression springs 28 and guide washer 26 are fitted to the rods. The lock washer 27 is then secured by engaging the rods through the key-shaped holes, and then turning the washer 27 so that grooves 32 at the ends of the rods come into engagement with the narrower portions of the key-hole-shaped openings 30. The fixing plate 19 is thus urged against the dog member 21 by the compression springs 28 and is normally situated a distance in on the motor shaft 16. The assembly is disengaged by urging the pressure plate 25 towards the dog member 21, the fixing plate 19 then being taken to a position flush with the end of the motor shaft. In this position, the type element with its hooks may be moved down onto the fixing plate. If the fixing plate with the type element is subsequently allowed to spring back, the type element is taken up onto the motor shaft 16 and latched thereon simultaneously as a guide on the type element engages with the guide recess 22 on the dog member for retaining the type element in its correct angular position.

Control of the printing element motor is adapted such that the motor shaft assumes a so-called home or viewable position when the motor is not activated. This means that the motor shaft automatically assumes a position where the guide recess 22 of the dog member is directed vertically upwards. In this position it is also possible to observe the writing under the type element, since a section of the upper portion of the type element is removed.

Figure 3:
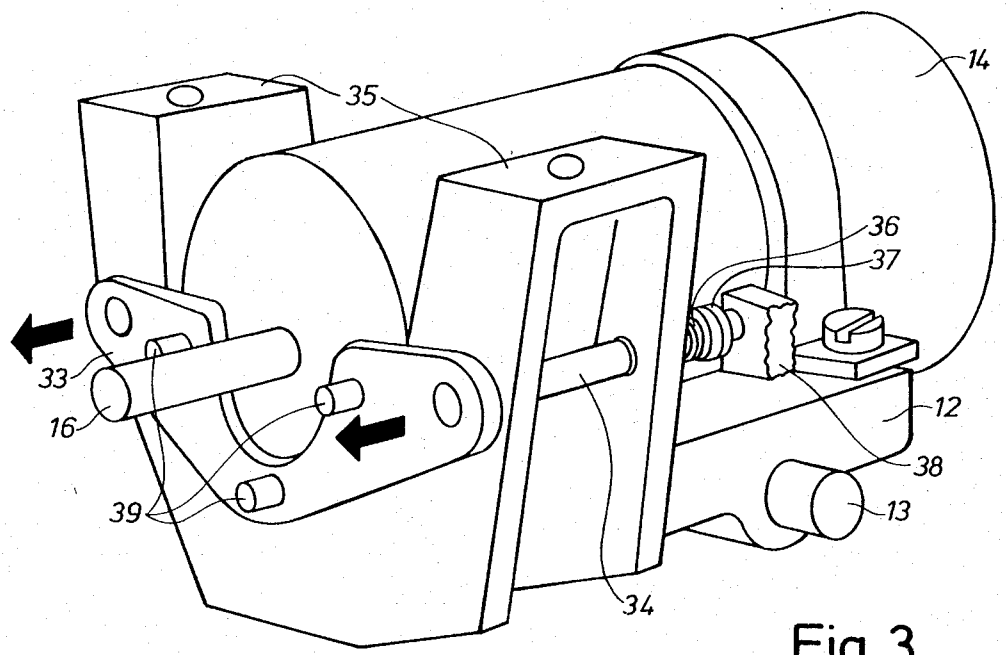
FIG. 3 is a perspective view of a locking mechanism and a mechanism for locating a type element.

The arrangement for actuating the pressure disk 25 is illustrated in FIG. 3, and comprises a disengagement plate 33, reciprocally movable parallel to the motor shaft 16 by means of a pair of rods 34. For their reciprocatory motion the rods 34 are guided in an upper member 35 of the structure 12, which also carries the type element motor. The rods are surrounded by compression springs 36 placed between member 35 and lock washers 37 mounted on the rods, the disengagement plate normally being kept pressed against the end wall of the type element motor. The ends of the rods 34 can be brought into engagement with a stop 38 on the carriage when the support structure is pivoted, and during this movement the stop actuates the rods 34 so that the disengagement plate 33 is urged towards the pressure plate 25, whereby the fixing plate 19 is moved out to the shaft end and the type element 17 can be released. To ensure that the type element is locked in an angular position suitable for removal, i.e. the so-called home position, the disengagement plate 33 is provided with three detent pins 39 coacting with recesses 24 in the lock collar 23. The pins 39 as well as the recesses 24 are mutually asymmetrically distributed around the end wall of the lock collar to ensure that the support structure 12 cannot be tipped as long as the type element is not in the home position.

The apparatus operates in the following manner.

Figure 2:
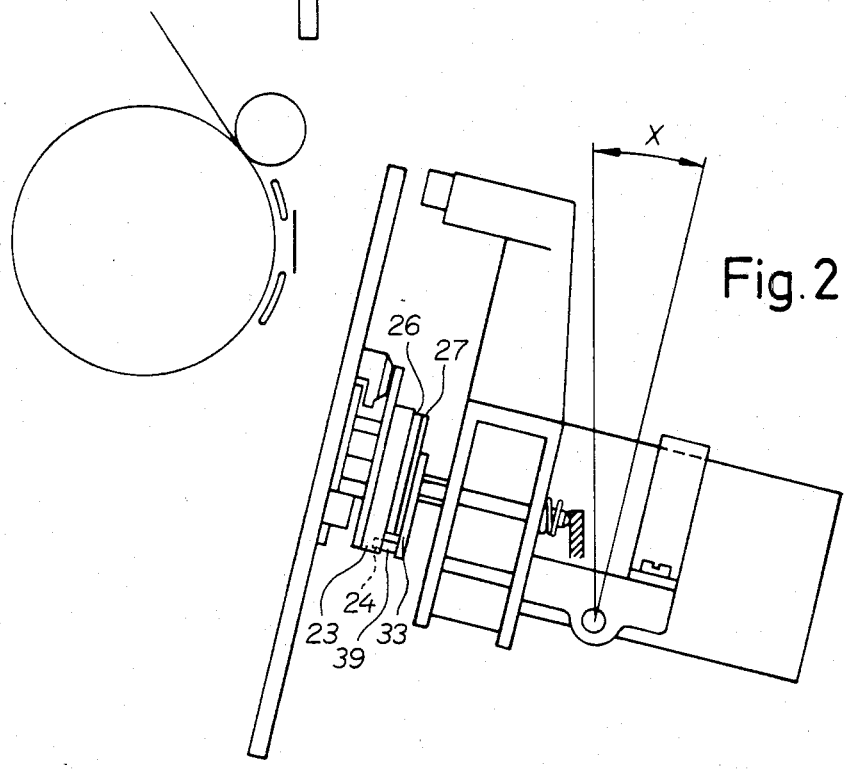
FIG. 2 is a side view illustrating the printing apparatus in an upwardly pivoted position.

In its normal printing position, i.e. the position illustrated in FIG. 1, the support unit is locked in its forward position. In this position the type element is thrust on the shaft 16 by the coupling 18 being inactive. In this position, the type element accompanies the rotary movement of the shaft via the intermediary of the dog member 21. When a type element is to be exchanged and it is in its home position, the fixing plate 19 is in a suitable position to receive the new type element. In this position, the recesses 24 in the lock collar 23 are situated directly opposite the detent pins 39 on the disengagement plate 33 and the support structure can be pivoted upwards to the position illustrated in FIG. 2 by means not shown. During the pivoting movement, the detent pins 39 enter the recesses 24, the dog member 21 and the fixing plate 19 being retained in this position during replacement of the type element. During the pivoting movement, the stop 38 actuates the rods 34 so that the disengagement plate 33 moves the pressure plate 25 and thereby the fixing plate 19 towards the outer end of the shaft 16. During this movement, the type element guide moves out of engagement with the guide recess 22 and the type element is moved outside the end of the shaft 16, for being lifted away from the fixing plate so that a new type element can be inserted. The support structure may subsequently be pivoted forward to its printing position, during which operation the type element becomes automatically located in relation to the motor shaft and the detent pins 39 come out of engagement with the recesses 24.

If, for some reason, the type element has not assumed a correct position for removal when the support structure is actuated for pivoting upwards, the detent pins 39 will come into engagement with the end wall of the lock collar 23, to inhibit the upward movement of the support structure. Not until the recesses 24 have come opposite the detent pins 39 as a result of the angular movement of the type element, can the completion of the pivoting movement be effected for releasing the type element.

I claim:

1. In an apparatus for the assembly of a printing apparatus for an electric office machine comprising a print unit including an electric motor having a drive shaft and a disk-like type element removably secured to said shaft, said print unit being pivotably movable between a printing position, in which said element is drivingly coupled to said shaft, and a pivoted position in which said element is disengaged from said shaft for replacement, and locking means for permitting pivotal movement of the print unit from said printing position to said pivoted position only when said type element is in a predetermined angular position, the improvement wherein the locking means comprises a lock collar member rigidly attached to the motor shaft and having an end face, and a disengagement means including a disengagement member facing said end face of said collar member and displaceable axially of said shaft towards said collar member during pivotal movement of the unit, one of said members including a plurality of axially extending pins, the other member being provided with a plurality of complementary recesses which are in engagement with said pins only when said type element is in said predetermined annular position, the pivotal movement of said unit to said pivoted position being permitted only with said pins engaged in said recesses.

2. The improvement as claimed in claim 1 wherein said recesses and pins are each three in number and are disposed on said members asymmetrically around said shaft.

3. The improvement as claimed in claim 2 wherein said collar member is tubular.

4. The improvement as claimed in claim 3 wherein said end face is provided with said recesses.

5. The improvement as claimed in claim 1 wherein said disengagement means further comprises rods axially displaceably mounted parallel to the motor shaft, said disengagement member comprising a plate secured to said rods, and a fixed stop for engaging at least one of said rods when the unit is in pivoted position to produce axial displacement of said plate.

6. The improvement as claimed in claim 5 wherein said collar member is tubular and said end face is provided with said recesses, said pins being disposed on said plate.

7. The improvement as claimed in claim 6 wherein said disengagement means further comprises a spring member engaging at least one of said rods to urge said rod towards said stop.

8. The improvement as claimed in claim 7 wherein said spring member comprises a helical spring surrounding said one rod, said print unit comprising a support member slidably supporting said rods, and a second stop on said one rod, said spring being compressed between said support member and said second stop.

* * * * *